US006668931B1

(12) United States Patent
Tomlinson et al.

(10) Patent No.: US 6,668,931 B1
(45) Date of Patent: Dec. 30, 2003

(54) APPARATUS AND METHOD FOR CLEANING A GAS WELL

(76) Inventors: Jim Tomlinson, R.R. 1, Site 8, Box 14, Millet, Alberta (CA), T0C 1Z0; John Hickie, 68 Anderson Park Street, Brooks, Alberta (CA), T1R 0K5

( * ) Notice: Subject to any disclaimer, the term of this patent is extended or adjusted under 35 U.S.C. 154(b) by 0 days.

(21) Appl. No.: 10/192,396

(22) Filed: Jul. 8, 2002

(51) Int. Cl.[7] ..... E21B 37/00; E21B 21/12

(52) U.S. Cl. ..... 166/311; 166/312; 166/267; 166/90.1

(58) Field of Search ..... 166/311, 312, 166/267, 90.1

(56) References Cited

U.S. PATENT DOCUMENTS 1,858,847 A * 5/1932 Young ..... 166/372
3,700,034 A * 10/1972 Hutchison ..... 166/312
3,887,008 A 6/1975 Canfield
4,017,120 A 4/1977 Carlson et al.
4,410,041 A * 10/1983 Davies et al. ..... 166/300
4,799,554 A * 1/1989 Clapp et al. ..... 166/312
4,896,725 A 1/1990 Parker et al.
4,929,348 A 5/1990 Rice
5,103,914 A * 4/1992 LaHaye ..... 166/310
5,339,905 A * 8/1994 Dowker ..... 166/369
5,547,021 A 8/1996 Raden
5,685,374 A 11/1997 Schmidt et al.
6,032,737 A 3/2000 Brady et al.
6,053,249 A 4/2000 Stevenson et al.
6,129,150 A 10/2000 Lima
6,315,048 B1 11/2001 Etzkorn
6,595,287 B2 * 7/2003 Fisher ..... 166/250.15

* cited by examiner

*Primary Examiner*—David Bagnell
*Assistant Examiner*—Daniel P Stephenson
(74) *Attorney, Agent, or Firm*—Gene Scott-Patent Law & Venture Group

(57) ABSTRACT

An apparatus for cleaning a natural gas well bore, including a master valve capping the well bore, the master valve supporting a blowout preventor and injector head. The master valve is interconnected with a pressure vessel through a first control valve and the pressure vessel is interconnected with a compressor and with a gas pipeline through a second and a third control valves. The compressor provides compressed natural gas from the pressure vessel to the well bore through the injector head and the master valve via a tubing reel inserted into the well bore.

7 Claims, 3 Drawing Sheets

APPARATUS AND METHOD FOR CLEANING A GAS WELL

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to apparatus and methods for cleaning a gas well and more particularly to such a an apparatus mounted on a vehicle and method of its use.

2. Description of Related Art

The following art defines the present state of this field:

Canfield, U.S. Pat. No. 3,887,008 describes a gas compressor of the jet type positioned downhole in a gas producing well. The inlet of the compressor is exposed to formation fluids comprising natural gas and a liquid, usually water. High pressure natural gas is continuously delivered to a power fluid inlet of the jet compressor. A mixture of the power gas and produced formation fluids are continuously delivered from the high pressure compressor outlet through a production string to the surface at a pressure and volume sufficient to keep the production string unloaded of liquids.

Carlson et al., U.S. Pat. No. 4,017,120 describes hot brines containing dissolved gases are produced from liquid-dominated geothermal wells by utilizing lift gases of essentially the same composition as said dissolved gases. The lift gas is separated from the produced brine and recycled. Heat is abstracted from the separated brine, which may be returned to the aquifer, processed for its mineral content or discarded. The gas lift is carried out under temperature and pressure conditions such that precipitation of minerals from the brine does not occur in the well bore. The problems which would result from the use of oxygen-containing and/or brine-soluble inert gases for the lifting operation are avoided. The problems attendant upon production of hot brines by pumping are also avoided.

Parker et al., U.S. Pat. No. 4,896,725 describes an in-well heat exchange method for improved recovery of subterranean fluids with poor flowability. The method includes conducting a fluid from a subterranean formation through a well in fluid communication therewith to the surface, and flowing a heated gas enriched in C.sub.5 plus hydrocarbons from the surface into the well in heat exchange relationship with the fluid conducted from the formation. In one embodiment, the heated gas is injected into the subterranean fluid as a lift gas to artificially lift the subterranean fluid to the surface, wet gas is separated from the produced fluid, and a portion of the recovered gas is heated and compressed for recycle as the lift gas.

Rice, U.S. Pat. No. 4,929,348 describes improvements in processes and apparatus for effecting solvent extractions using liquefied gas or gases in the supercritical state as the solvents and specifically to continuous processes for carrying out such extractions at high pressures. Further, the present invention relates to an apparatus which is a long vertical cylinder of relatively small diameter, wherein the solvent gas and the material to be extracted are continuously circulated through the long vertical reactor.

Raden, U.S. Pat. No. 5,547,021 describes a method and apparatus for producing a well by varying its downhole pressure. A vacuum is applied to the top of a single string of tubing in a cased wellbore to encourage the formation of free gas at the bottom of the tubing string. The resulting free gas entrains reservoir liquids proximate the inlet opening in the tubing bottom and reduces the pressure gradient in the tubing thus maximizing fluid flow rates to the surface. To further enhance production rates in the event that reservoir gas/oil ratios are too low, supplemental gas volumes may be delivered to the well casing/tubing annulus.

Schmidt et al., U.S. Pat. No. 5,685,374 describes weakly consolidated hydrocarbon fluid bearing earth formation zones having a cohesive strength of about 500 psi or less, which are produced by completing a well penetrating the zone and initiating production of solids laden fluid from the zone through the well to generate a near wellbore cavity. Production of solids laden fluid is continued until the cavity grows to a point wherein the fluid velocity across the cavity face decreases to a value below, the solids particulate transport velocity wherein continued production of fluid will result in a very low or negligible rate of production of solids particulates. Solids particulates are separated from the produced mixture at the surface, the solids are treated to reduce the particle size and reinjected in a slurry into a disposal well for disposal in a hydraulically fractured or disaggregated formation zone remote from the production zone. Cavity growth and production may be carried out by throttling a free flowing well or by artificial lift, preferably utilizing power fluid and a hydraulic jet pump or gas lift techniques.

Brady et al., U.S. Pat. No. 6,032,737 describes a method and system for increasing oil production from an oil well producing a mixture of oil and gas at an elevated pressure through a wellbore penetrating an oil-bearing formation containing an oil-bearing zone and an injection zone, by separating at least a portion of the gas from the mixture of oil and gas to produce a separated gas and an oil-enriched mixture; utilizing energy from at least a portion of the mixture of oil and gas to compress at a surface at least a portion of the separated gas to produce a compressed gas having sufficient pressure to be injected into the injection zone; injecting the compressed gas into the injection zone; and recovering at least a major portion of the oil-enriched mixture.

Stevenson et al., U.S. Pat. No. 6,053,249 describes a method and apparatus for injecting gas into a subterranean formation wherein the gas to be injected is mixed with a carrier fluid (e.g. water) at the surface to form a mixture which is then flowed down a wellbore. The mixture is flowed through a downhole separator to separate at least a portion of the gas from the mixture which is then injected into the formation. The carrier fluid and any unseparated gas are then returned to the surface to be separated whereby the carrier fluid can be recycled in the gas injection process.

Lima, U.S. Pat. No. 6,129,150 describes a subsea primary separating vessel, which is installed close to the wellhead of an oil-producing well to effect primary separation of the liquid and gas phases of the produced fluids. A line connected to the top of the separating vessel allows the separated gases to flow to a collecting vessel located at any gathering station. The liquid phase flows to the gathering center through a flow line, which distributes the fluids into a U-shaped pipe length, each end of which is connected to a flow line along which the liquid phase flows to a surge tank. When the volume, of liquid phase which has settled out within the flow lines begins to exert a back pressure which has a prejudicial effect on well production, high pressure gas can be injected into the flow lines for a specific period of time to promote flow of the liquid phase to the surge tank.

If it is desired to increase the efficiency of the flow, a mechanical interface driven by the high pressure gas may be used to promote removal of the liquid phase.

Etzkorn, U.S. Pat, No. 6,315,048 describes a system and process for reducing the flowing bottom-hole pressure in a natural gas well having a first discrete fluid flow path extending from the surface well head through a valve to an inlet of a separator, the valve being actuatable between a closed condition and an open condition, and a second discrete gas flow path extending from an outlet of the separator to an inlet of a compressor, the compressor maintaining a near or below zero PSIG pressure at the separator inlet. When the valve is in the closed condition, positive pressure builds on the well head side of the valve and, when the valve is in the open condition, the near or below zero PSIG pressure of the separator is applied to the well head. In applications for receiving a fluid column of gas and liquid loading a plunger in the production line of a natural gas well, when the negative pressure is applied to the well head, the fluid column is transferred along the fluid flow path into the separator and the gas is transferred along the gas flow path from the separator to the compressor.

The prior art teaches downhole gas compression techniques, production of hot brines from liquid-dominated geothermal well by gas lifting, in-well heat exchange in subterranean fluids having poor flow characteristics, extractions in subterranean wells, fluid production from a wellbore, methods for increasing oil production from a well, methods for injecting gas into a subterranean formation, methods for offshore oil production by gas injection, and reduction of bottom hole pressure, but does not teach the use of a vehicle mounted well bore cleanout equipment and method. The present invention fulfills these needs and provides further related advantages as described in the following summary.

SUMMARY OF THE INVENTION

The present invention teaches certain benefits in construction and use which give rise to the objectives described below.

A mobile apparatus for cleaning a natural gas well bore, including a master valve capping the well bore, the master valve supporting a blowout preventor and injector head. The master valve is interconnected with a pressure vessel through a first control valve and the pressure vessel is interconnected with a compressor and with a gas pipeline through a second and a third control valves. The compressor provides compressed natural gas from the pressure vessel to the well bore through the injector head and the master valve via a tubing reel inserted into the well bore.

A primary objective of the present invention is to provide an apparatus and method of use of such apparatus that provides advantages not taught by the prior art.

Another objective is to provide such an invention mounted on a vehicle and capable of cleaning sand and water out of a gas well.

A further objective is to provide such an invention capable of being move between wells with little difficulty.

A still further objective is to provide such an invention capable of ease of use and low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
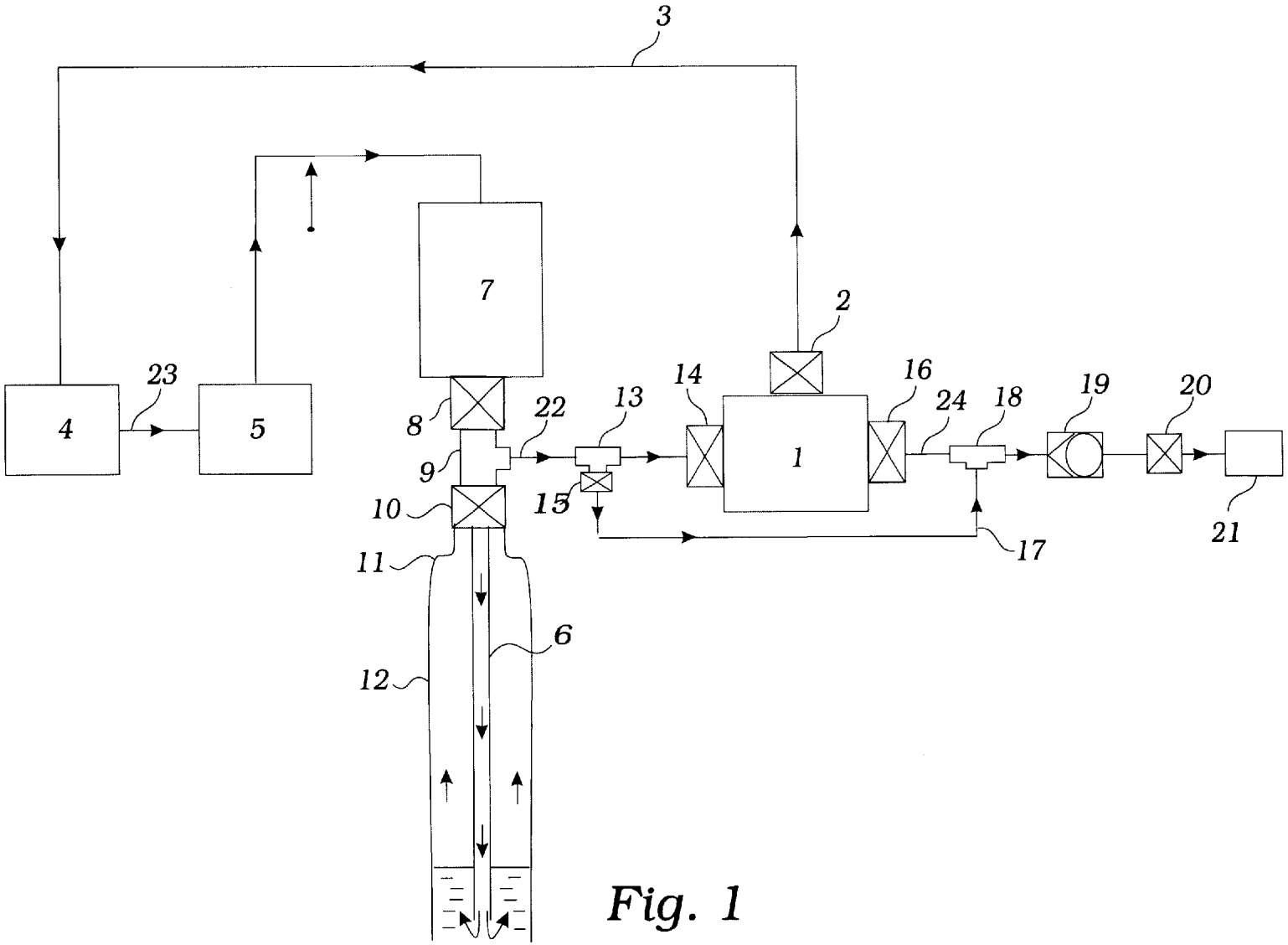
FIG. 1 is a block diagram of the preferred embodiment of the invention.
Figure 3:
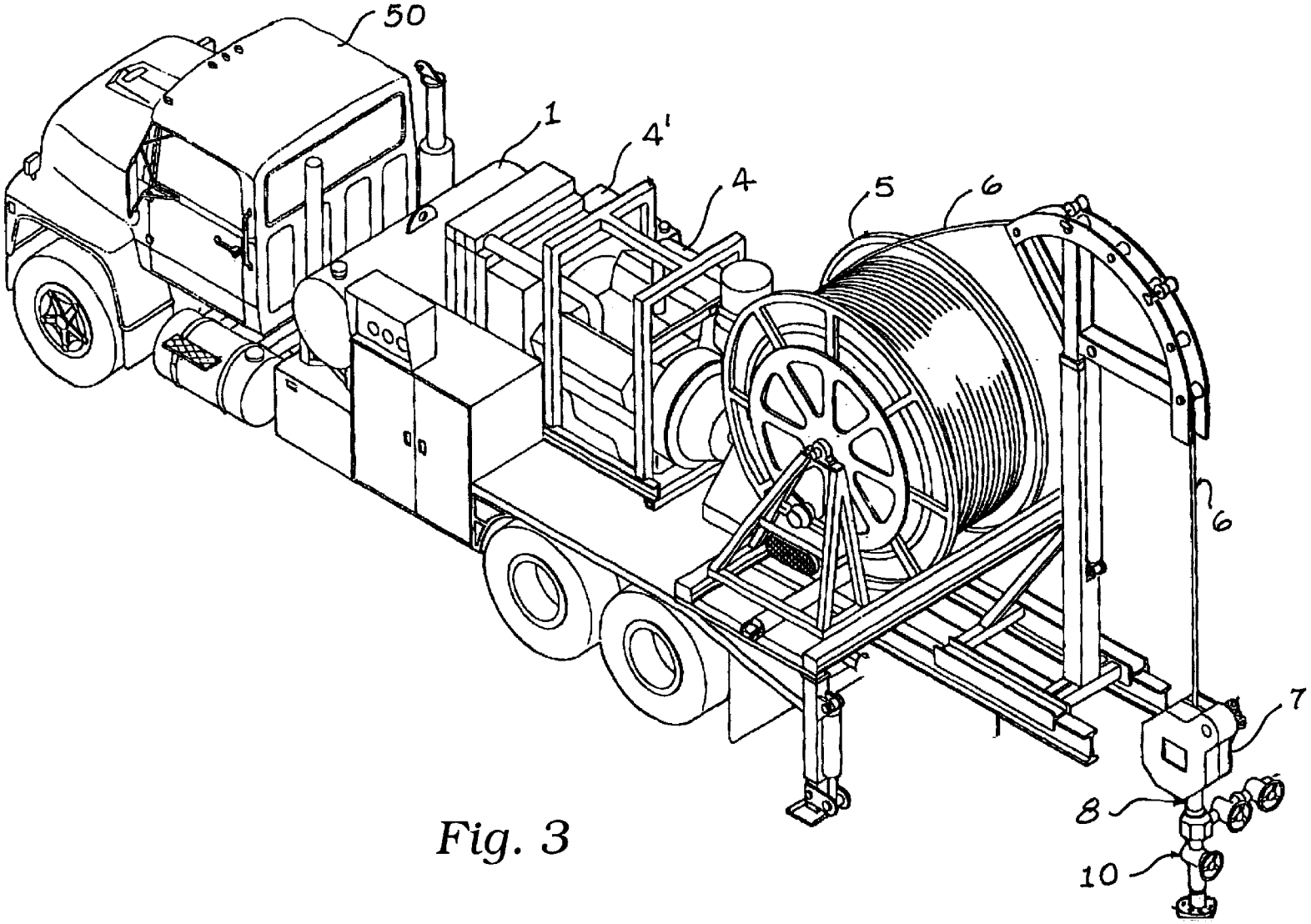
FIG. 3 is a perspective view of a vehicle adapted for performing operations thereof.

The present invention, as shown in FIG. 3, is a vehicle 50 mounted apparatus for cleaning a natural gas well bore 12. As shown in FIG. 1, a master valve 10 is engaged for capping the well bore 12, the master valve 10 supporting a blowout preventor 8, as is known in the art, and an injector head 7 mounted above the blowout preventor 8. The master valve 10 is interconnected with a pressure vessel 1 through a vessel control valve 14. The pressure vessel 1 is interconnected with a compressor 4 through a gas pipeline 3 via a pressure control valve 2. The compressor 4 provides compressed natural gas from the pressure vessel 1 to the well bore 12 through the injector head 7 via the master valve 10 through tubing 6 wound on a tubing reel 5, the tubing terminating in the well bore 12.

The apparatus further comprises a bypass line 17 from the master valve 10 to an outgoing pipeline 21.

The apparatus further comprises a check valve 19 and a pipeline control valve 20 in a line between the pressure vessel 1 and the outgoing pipline 21.

Components of the apparatus are mounted on the vehicle 50 as shown in FIG. 3, including compressor 4, a tubing reel 5 and tubing 6. In a manner known to those of skill, the tubing 6 is taken off reel 5 and inserted into injector head 7, blowout preventor 8 and master valve 10 to enter well head 11.

A apparatus described above is used in a method for cleaning the natural gas well bore 12. The method comprises the steps of moving the apparatus on a vehicle to a well site; capping the well bore 12 with the master valve 10, which has a blowout preventor 8 mounted on it, preferably through a tee 9, as shown in FIG. 1. Injector head 7 is then mounted on the blowout preventor 8. The master valve 10 is then interconnected with the pressure vessel 1 through the vessel control valve 14 and the pressure vessel 1 is connected with the compressor 4 via the gas pipeline 3 via the pressure control valve 2: Natural gas is then provided from the pressure vessel 1 to the well bore 12 through the compressor 4, injector head 7 and the master valve 10 with the tubing 6 from tubing reel 5 inserted into the well bore 12.

Figure 2:
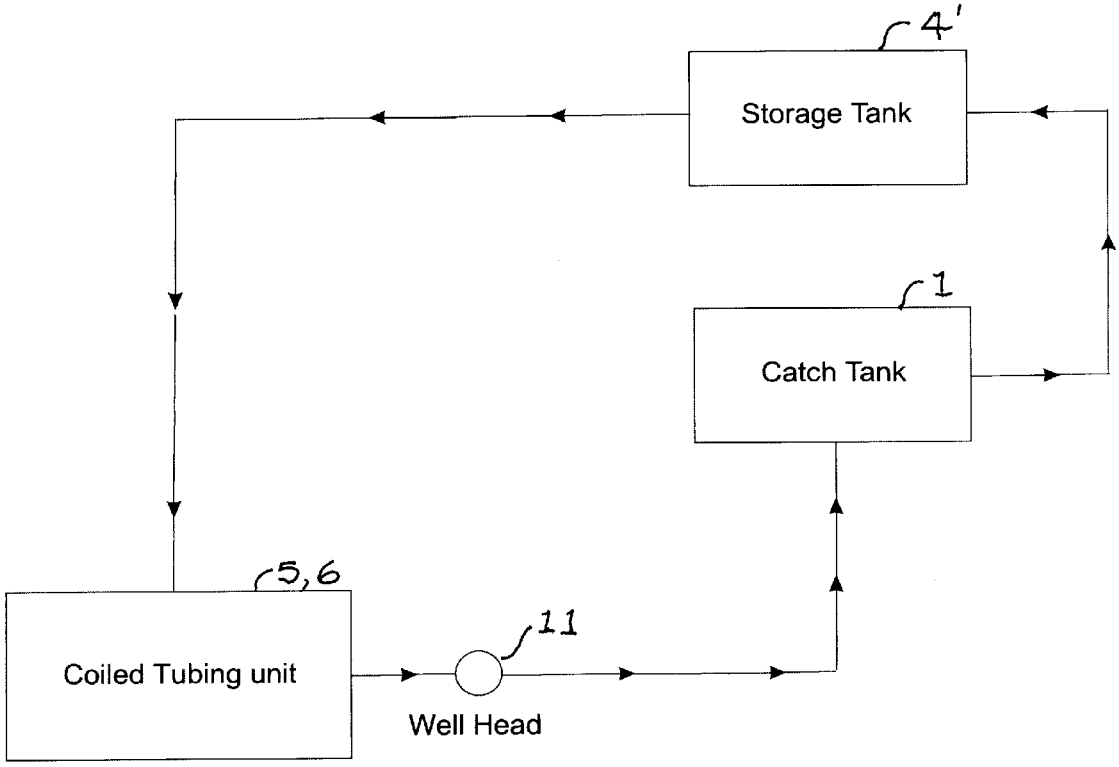
FIG. 2 is a block diagram of a coiled tubing unit, storage tank catch tank and well head thereof.

In FIG. 2 is shown the basic cycle of the method of the present invention, wherein, catch tank, otherwise referred to as pressure vessel 1 receives material and gas moving from the well head 11. Gas is transferred to storage tank 4' which is part of the compressor 4. The compressed gas then moves through the coiled tubing unit comprising reel 5 and tubing 6 to the well head 11.

The method further comprises the step of providing the bypass line 17 from the master valve 10 to the outgoing pipeline 21.

The method further comprising the step of providing the check valve 19 and the pipeline control valve 20 between the pressure vessel 1 and the outgoing pipline 21.

The method further preferably includes the steps of introducing the coiled tubing 6 into the injector head 7 and with the master valve 10 open, i.e., inserting the coiled tubing 6 into the well bore 12. This is followed by closing the blowout preventor 8 to cause a seal around the coiled tubing 6 and then extracting natural gas from the well bore 12 into the pressure vessel 1. This is followed by the steps of compressing the extracted natural gas taken from the pressure vessel; injecting the compressed natural gas into the well bore; extracting well bore clogging materials from the well bore and into the pressure vessel; withdrawing the coiled tubing into the blowout preventor; closing the master valve 10; and compressing any remaining natural gas and delivering said gas to the pipeline.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for cleaning a natural gas well bore, the apparatus comprising: a vehicle providing in combination: a master valve for capping the well bore, the master valve supporting a blowout preventor and an injector head mounted thereon; the master valve interconnected with a pressure vessel through a vessel control valve; the pressure vessel interconnected with a compressor and with an outgoing gas pipeline through control valves; the compressor providing compressed natural gas from the pressure vessel to the well bore through the injector, head and the master valve through a tubing taken from a tubing reel and then inserted into the well bore.

2. The apparatus of claim 1 further comprising a bypass line from the master valve to the pipeline.

3. The apparatus of claim 2 further comprising a check valve and a pipeline valve in a line between the pressure vessel and the pipline.

4. A method for cleaning a natural gas well bore, the method comprising the steps of: moving a vehicle mounted equipment having a compressor, pressure vessel and reel of tubing to a well site; capping a well bore with a master valve having a blowout preventor and injector head mounted thereon; interconnecting the master valve with a pressure vessel through a vessel control valve, interconnecting the pressure vessel with the compressor and with a outgoing gas pipeline through control valves respectively; providing compressed natural gas from the pressure vessel to the well bore through the compressor, injector head and the master valve with a tubing reel inserted into the well bore.

5. The method of claim 4 further comprising the step of providing a bypass line from the master valve to the pipeline.

6. The method of claim 5 further comprising the step of providing a check valve and a further control valve in a line between the pressure vessel and the pipline.

7. A method for cleaning a natural gas well bore, the method comprising the steps of: moving a vehicle to a well site, the vehicle providing a compressor joined with a pressure vessel and a tubing reel with coiled tubing; capping a well bore with a master valve having a blowout preventor and an injector head mounted thereon; interconnecting the master valve with a pressure vessel through a vessel control valve; interconnecting the pressure vessel with a compressor and with an outgoing pipeline through further control valves; providing a bypass line from the master valve to the pipeline and providing a check valve and a control valve in a line between the pressure vessel and the pipline; introducing the coiled tubing into the injector head and with the master valve open inserting the coiled tubing into the well bore; closing the blowout preventor to cause a seal around the coiled tubing; extracting natural gas from the well bore into the pressure vessel; compressing the extracted natural gas taken from the pressure vessel; injecting the compressed natural gas into the well bore; extracting well bore clogging materials from the well bore and into the pressure vessel; withdrawing the coiled tubing into the blowout preventor; closing the master valve; and compressing any remaining natural gas and delivering said gas to the pipeline.

* * * * *